US005930575A

United States Patent [19]

Fornalik et al.

[11] Patent Number: 5,930,575

[45] Date of Patent: Jul. 27, 1999

[54] APPARATUS AND METHOD FOR REDUCED PHOTORECEPTOR IMPACT BY A RETRACTABLE CLEANER

[75] Inventors: Anthony C. Fornalik, Webster; Christopher B. Miller, Fairport; Ronald E. Auty; Norman E. LaTour, both of Rochester; Nicholas M. Soures; Bruce E. Thayer, both of Webster, all of N.Y.

[73] Assignee: Xerox Corporation, Stamford, Conn.

[21] Appl. No.: 08/934,581

[22] Filed: Sep. 22, 1997

[51] Int. Cl.[6] ..... G03G 21/00

[52] U.S. Cl. ..... 399/345

[58] Field of Search ..... 399/343, 345

[56] References Cited

U.S. PATENT DOCUMENTS 4,174,172 11/1979 Lane ..... 399/345 X 4,519,699 5/1985 Mayer et al. ..... 399/345

5,669,055 9/1997 Thayer et al. ..... 399/345

*Primary Examiner*—Fred L. Braun

[57] ABSTRACT

An apparatus, method and printing machine that utilizes a ramped backer and/or a shock absorbing material in a cleaner subsystem to reduce or prevent photoreceptor motion quality disturbances. The shock absorbing material prevents an instantaneous high impact force between the spacer wheel and the photoreceptor backer bar that can cause photoreceptor motion quality disturbance. The ramped backer prevents the instantaneous deceleration of the spacer wheel with the backer that causes motion quality disturbance due to the shaking of the photoreceptor belt from the impact on contact. The combination of the shock absorbing material and the ramped backer create a preferred embodiment to prevent photoreceptor motion quality disturbance by the cleaner system.

22 Claims, 8 Drawing Sheets

APPARATUS AND METHOD FOR REDUCED PHOTORECEPTOR IMPACT BY A RETRACTABLE CLEANER

BACKGROUND OF THE INVENTION

This invention relates generally to an electrostatographic printer and copier, and more particularly, a cleaning system that reduces photoreceptor motion quality impact and sets a proper brush to photoreceptor interference (BPI).

A multipass IOI xerographic system requires a cleaning subsystem which is able to engage and retract from the photoreceptor. Since the cleaner must remove all untransferred toner, while not disturbing the new, pre-transferred images, the engagement motion must occur during the interdocument zone. In order to place the cleaner in a typical 50 mm interdocument zone, high engagement speeds must be used.

BPI is one of the key critical parameters in any cleaner, and is directly related to the cleaning performance. The mass of the cleaner, combined with the fast engagement speeds, causes the cleaner spacer wheels to impact the backer bars with a large transient force. This impact force disturbs image quality by effectively shaking the photoreceptor belt module with respect to the ROS. A method and/or apparatus is needed to reduce or prevent the disturbance of image quality.

Furthermore, a multipass IOI xerographic system requires a cleaning subsystem which retracts. In addition to the requirement for acceptable cleaning of toner off of the photoreceptor, the cleaner must have a low impact force on the photoreceptor belt module in order to not disturb image quality. Traditional photoreceptor backers for retracting cleaners have consisted of a single contact point to set the cleaner position as it engages. This configuration serves to decelerate the cleaner engagement motion instantaneously causing a jarring impact to the photoreceptor backer and a ringing vibration to the photoreceptor module.

The following disclosure may be relevant to various aspects of the present invention and may be briefly summarized as follows:

U.S. Pat. No. 5,597,419 to an apparatus and method for moving a cleaning brush, periodically or continuously, to avoid flat spots or voids in the cleaning brush fibers when the printing machine is in standby or off. Periodic movement of the cleaning brush or slow rotation of the cleaning brush when the machine is in a non-operational mode prevents brush "set" from occurring thus, preventing photoreceptor motion quality errors in the printing operation.

U.S. Pat. No. 5,519,480 to Thayer et al. discloses an apparatus and method for cleaning particles from a moving imaging surface. Backers are retracted from the photoreceptor to release cleaning contact between the brushes and the moving imaging surface during development of image-on-image in the multi-pass cycle. After transfer of the image, the backers move into contact with one side of the photoreceptor causing the moving imaging surface, on the other side of the photoreceptor, to contact the cleaner brushes. The brushes clean the moving imaging surface of the photoreceptor. The brushes are released from contact with the moving imaging surface when the backers are retracted, allowing the image on image multi-pass process to begin again. The brushes engage and disengage the photoreceptor in the interdocument zone (i.e. non-imaging region) of the moving surface.

SUMMARY OF INVENTION

Briefly stated, and in accordance with one aspect of the present invention, there is provided an apparatus for reducing and preventing motion quality defects of an imaging surface by a cleaning subsystem comprising: a retractable cleaner member, having a first position and a second position, for cleaning the imaging surface, the retractable cleaner member being movable between the first position and the second position; a spacer member to maintain a desired distance between the imaging surface and the retractable cleaner member during engagement therebetween; and a backer member being positioned opposite the spacer member to decelerate the spacer member, the backer member and the spacer member preventing an instantaneous high impact contact therebetween to prevent a motion quality disturbance of the imaging surface by the cleaning subsystem.

Pursuant to another aspect of the present invention, there is provided an apparatus for reducing and preventing motion quality defects of an imaging surface cleaning subsystem comprising: a retractable cleaner member, having a first position and a second position, for cleaning the imaging surface, the retractable cleaner member being movable between the first position and the second position; a spacer member for maintaining a desired distance between the imaging surface and the retractable cleaner member during engagement therebetween; a ramped backer member, being positioned opposite the spacer member, to gradually decelerate the spacer member to reduce an impact force between the ramped backer member and the spacer member; and the spacer member having a shock absorbing material to prevent an instantaneous high impact force contact between the spacer member and the ramped backer member that causes motion quality disturbance of the imaging surface.

Pursuant to another aspect of the present invention, there is provided an electrostatographic printing machine comprising: an imaging surface, capable of movement, advances past a charging station for charging of the imaging surface; an exposure station through which the imaging surface moves, the imaging surface having charged portions being exposed to a scanning device that discharges the imaging surface forming a latent image thereon; a development station advances toner particles into contact with the latent image on the imaging surface as the imaging surface moves through the development station; a transfer station advances a print media for transfer of the toner particles adhered to the latent image onto the print media, the toner particles of the latent image being permanently affixed to the print media via fusing of the latent image of toner particles to the print media; and a cleaning station for removal of the toner particles remaining on the imaging surface after transfer, the cleaning station including: a retractable cleaner member, having a first position and a second position, for cleaning the imaging surface, the retractable cleaner member being movable between the first position and the second position; a spacer member to maintain a desired distance between the imaging surface and the retractable cleaner member during engagement therebetween; a backer member being positioned opposite the spacer member to decelerate the spacer member, the backer member and the spacer member preventing an instantaneous high impact contact therebetween to prevent a motion quality disturbance of the imaging surface by the cleaning subsystem.

Pursuant to another aspect of the present invention, there is provided an apparatus for reducing and preventing motion quality defects of an imaging surface by a cleaning subsystem, comprising: a retractable cleaner member, having a first position and a second position, for cleaning the imaging surface, the retractable cleaner member being movable between the first position and the second position; a spacer member for maintaining a desired distance between the imaging surface and the retractable cleaner member during engagement therebetween; a ramped backer member, being positioned opposite the spacer member, to gradually decelerate the spacer member to reduce an impact force between the ramped backer member and the spacer member; and the spacer member comprising a dampening member to prevent an instantaneous high impact force contact between the spacer member and the ramped backer member that causes a motion quality disturbance of the imaging surface.

Pursuant to another aspect of the present invention, there is provided a method for preventing a motion quality disturbance of an imaging surface by a cleaner subsystem for removing particles therefrom, comprising: engaging a retractable cleaner member, having a first position and a second position, for cleaning the imaging surface, the retractable cleaner member being movable between the first position and the second position; using a spacer member to maintain a desired distance between the imaging surface and the retractable cleaner member during engagement therebetween; and decelerating the spacer member, using a backer member positioned opposite the spacer member, eliminating an instantaneously high impact contact between the spacer member and the backer member to prevent a motion quality disturbance to the imaging surface.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. Although the cleaning method and apparatus of the present invention is particularly well adapted for use in a color electrostatographic printing or copying machine, it should become evident from the following discussion, that it is equally well suited for use in a wide variety of devices and is not necessarily limited to the particular embodiments shown herein.

Figure 10:
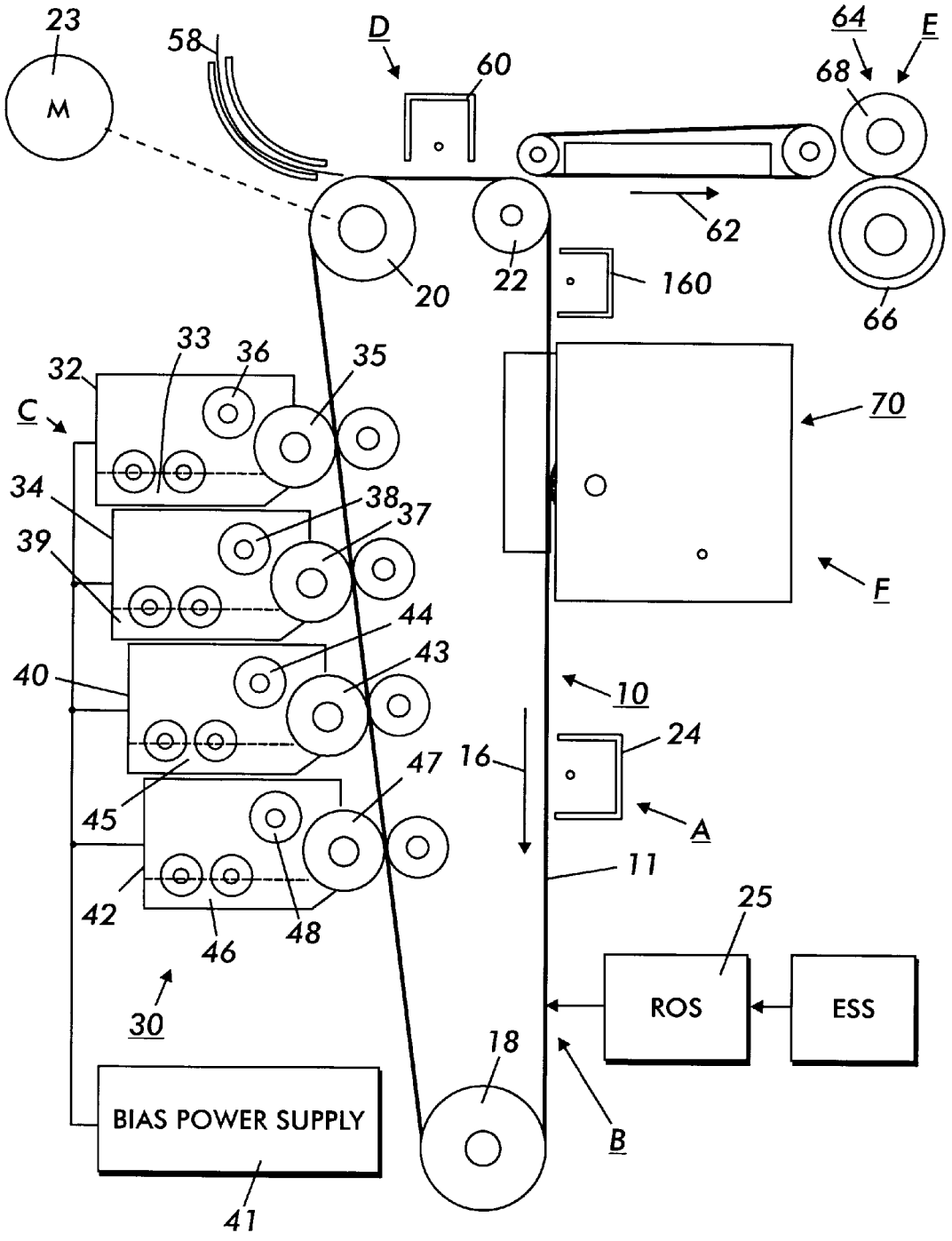
FIG. 10 is a schematic illustration of a printing apparatus incorporating the inventive features of the present invention.

Referring now to the drawings, where the showings are for the purpose of describing a preferred embodiment of the invention and not for limiting same, the various processing stations employed in the reproduction machine illustrated in FIG. 10 will be briefly described.

A reproduction machine, from which the present invention finds advantageous use, utilizes a charge retentive member in the form of the photoconductive belt 10 consisting of a photoconductive surface and an electrically conductive, light transmissive substrate mounted for movement past charging station A, and exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 20 to advance belt 10 in the direction of arrow 16. Roller 20 is coupled to motor 23 by suitable means such as a belt drive. As can be seen by further reference to FIG. 10, initially successive portions of belt 10 pass through charging station A. At charging station A, a corona device such as a scorotron, corotron or dicorotron indicated generally by the reference numeral 24, charges the belt 10 to a selectively high uniform positive or negative potential. Any suitable control, well known in the art, may be employed for controlling the corona device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device (for example, a two level Raster Output Scanner (ROS)).

The photoreceptor, which is initially charged to a voltage, undergoes dark decay to a voltage level. When exposed at the exposure station B it is discharged to near zero or ground potential for the image area in all colors.

At development station C, a development system, indicated generally by the reference numeral 30, advances development materials into contact with the electrostatic latent images. The development system 30 comprises first 42, second 40, third 34 and fourth 32 developer apparatuses. (However, this number may increase or decrease depending upon the number of colors, i.e. here four colors are referred to, thus, there are four developer housings.) The first developer apparatus 42 comprises a housing containing a donor roll 47, a magnetic roller 48, and developer material 46. The second developer apparatus 40 comprises a housing containing a donor roll 43, a magnetic roller 44, and developer material 45. The third developer apparatus 34 comprises a housing containing a donor roll 37, a magnetic roller 38, and developer material 39. The fourth developer apparatus 32 comprises a housing containing a donor roll 35, a magnetic roller 36, and developer material 33. The magnetic rollers 36, 38, 44, and 48 develop toner onto donor rolls 35, 37, 43 and 47, respectively. The donor rolls 35, 37, 43, and 47 then develop the toner onto the imaging surface 11. It is noted that development housings 32, 34, 40, 42, and any subsequent development housings must be scavengeless so as not to disturb the image formed by the previous development apparatus. All four housings contain developer material 33, 39, 45, 46 of selected colors. Electrical biasing is accomplished via power supply 41, electrically connected to developer apparatuses 32, 34, 40 and 42.

Sheets of substrate or support material 58 are advanced to transfer station D from a supply tray, not shown. Sheets are fed from the tray by a sheet feeder, also not shown, and advanced to transfer station D through a corona charging device 60. After transfer, the sheet continues to move in is the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to a catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually. Residual toner and debris remaining on photoreceptor belt 10 after each copy is made, may be removed at cleaning station F with a brush, blade or other type of cleaning system 70. A preclean corotron 161 is located upstream from the cleaning system 70.

In a full color, multipass Image on Image (IOI) xerographic machine, it is necessary to have a cleaner which can retract from and engage the photoreceptor (e.g. imaging surface). Since the cleaner must remove all untransferred toner, while not disturbing the new, pre-transferred images, the engagement motion must occur during the interdocument zone. In order to place the cleaner in a typical 50 mm interdocument zone, high engagement speeds must be used.

This speed requirement increases as the cleaner is retracted farther from the photoreceptor. In machines where it is necessary to remove the cleaner or photoreceptor for maintenance, an inherent variability in the spacing between the cleaner and the photoreceptor exists. In order to accommodate this variability, the cleaner has a wide latitude (+/−3 mm) where it can expect the photoreceptor to be. In order to always set a proper cleaner brush to photoreceptor interference (BPI), the cleaner brushes are equipped with spacer wheels. The spacer wheels contact backer bars outside of the photoreceptor (but part of the photoreceptor belt module) and set the BPI. Due to locational tolerances some amount of overtravel (i.e. the cleaner brush travels beyond the nominal photoreceptor backer bar position) of the cleaner is required for the spacer wheels to locate against the backers. Cleaner springs are compressed when the spacer wheels contact the photoreceptor backers during the overtravel portion of the engagement cycle.

Figure 1:
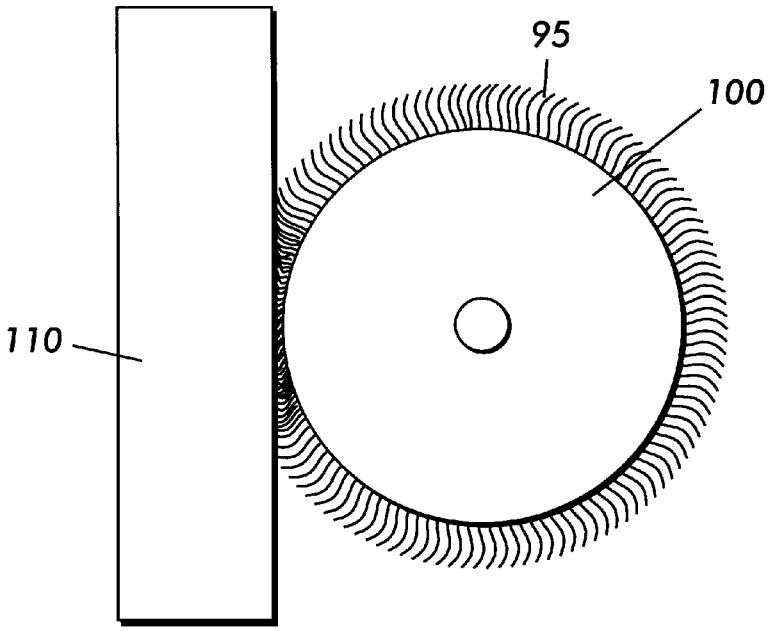
FIG. 1 PRIOR ART
FIG. 1 is a prior art schematic view of a spacer wheel controlling brush to photoreceptor interference (BPI) against a backer bar.

BPI is one of the key critical parameters in any cleaner, and is directly related to the cleaning performance. Ideally, the BPI is a fixed, predetermined value. If the retracting cleaner locational tolerances are large, then overtravel springs and spacer wheels become necessary to ensure a proper BPI. In FIG. 1, a spacer wheel 100 is shown in contact with a backer bar 110. The fibers 95 of a cleaner brush are shown extending radially beyond the diameter of the spacer wheel 100.

The mass of the cleaner, combined with the fast engagement speeds, causes the cleaner spacer wheels to impact the backer bars with a large transient force. This impact force disturbs image quality by effectively shaking the photoreceptor belt module with respect to the ROS (Raster Output Scanner).

In order to minimize motion quality impacts from the cleaner as it engages the photoreceptor, the present invention provides several methods is of adding shock-absorbing material to the cleaner brush. These methods cushion the brush impact, while maintaining a proper spacing relationship between the brush and the photoreceptor. Minimization of the motion quality impacts enables the creation of high quality images since the photoreceptor is not shaken with respect to the ROS.

The spacer wheels must be made of a rigid material, that is any material which is substantially rigid with a preference in this application to light materials. The rigidity is required in order to maintain a constant and predictable BPI. Soft spacer wheels can cause unacceptable BPI variance.

Figure 2:
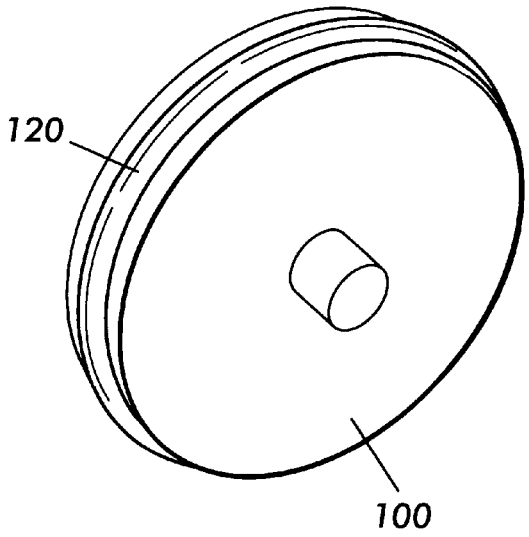
FIG. 2 is a perspective view of an O-ring inserted into a groove on the edge of a spacer wheel.
Figure 3A:
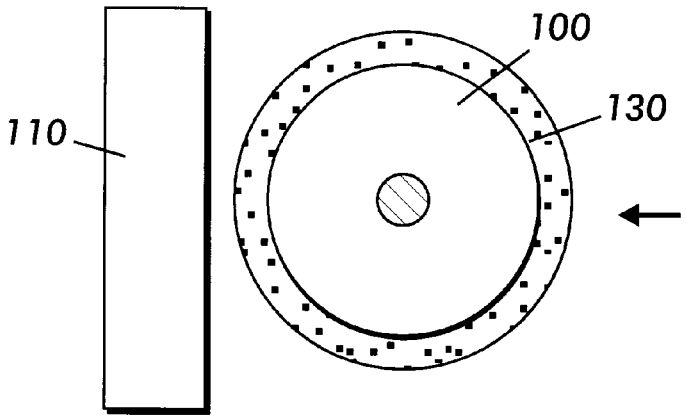
FIG. 3A is a schematic view of a foam coated spacer wheel out of contact with the photoreceptor.
Figure 3B:
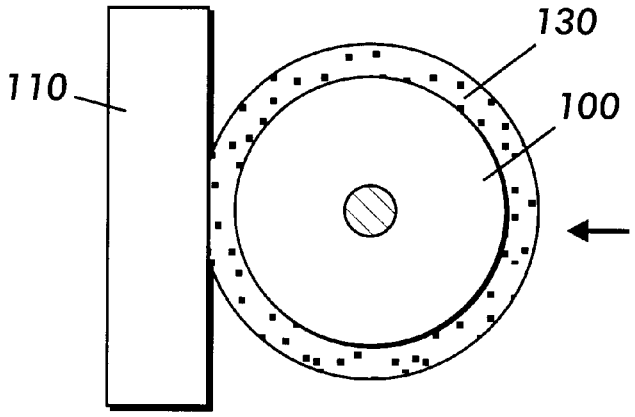
FIG. 3B is a schematic view of a foam coated spacer wheel compressing and decelerating upon contact with the photoreceptor.
Figure 3C:
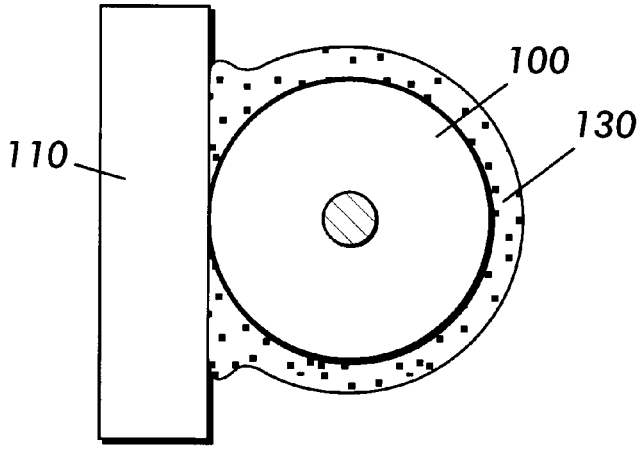
FIG. 3C is a schematic of a foam coated spacer wheel maintaining a fixed BPI.

Reference is now made to FIG. 2, which shows an embodiment of the present invention. This embodiment proposes adding a shock absorbing material (e.g. urethane, fiber, foam, elastomer, etc.) to the rigid spacer wheel 100 or the cleaner brush. A thin layer of soft material (e.g. urethane, fiber, foam, elastomer, etc.) could be coated on or slipped over the existing spacer wheels. On impact, the soft material absorbs the bulk of the impact force. The soft material then compresses, decelerating the cleaner without a high impact force, and allows the rigid material inside of the spacer wheel 100 to set the BPI. This can be accomplished in a variety of ways, including: 1) Adding a groove on the edge of the spacer wheel and inserting and O-ring 120 as shown in FIG. 2. The material properties of the O-ring 120, the thickness, elasticity, depth and shape of the groove in the spacer wheel may be optimized to provide minimal motion quality impact, while providing a proper BPI. 2) A second implementation is to use a foam ring to cover the contacting surface of the spacer wheel, as shown in FIGS. 3A–3C. This foam covering 130 may be closed or open celled, depending upon the type of properties desired for an application. The foam 130 operates similar to the rubber O-ring by dampening the impact force of the spacer wheel as the cleaner engages the photoreceptor. FIGS. 3A–3C show the steps of operation of the foam coated spacer wheel. FIG. 3A shows the foam coated spacer wheel 100 moving toward the backer 110 for the engagement of the cleaner with the photoreceptor (not shown). FIG. 3B shows spacer wheel 100 with the foam coating 130 at the beginning of compressing and decelerating to prevent the high impact force. FIG. 3C shows the spacer wheel 100 with the foam 130 coating compressed and a fixed BPI being maintained.

Figure 4:
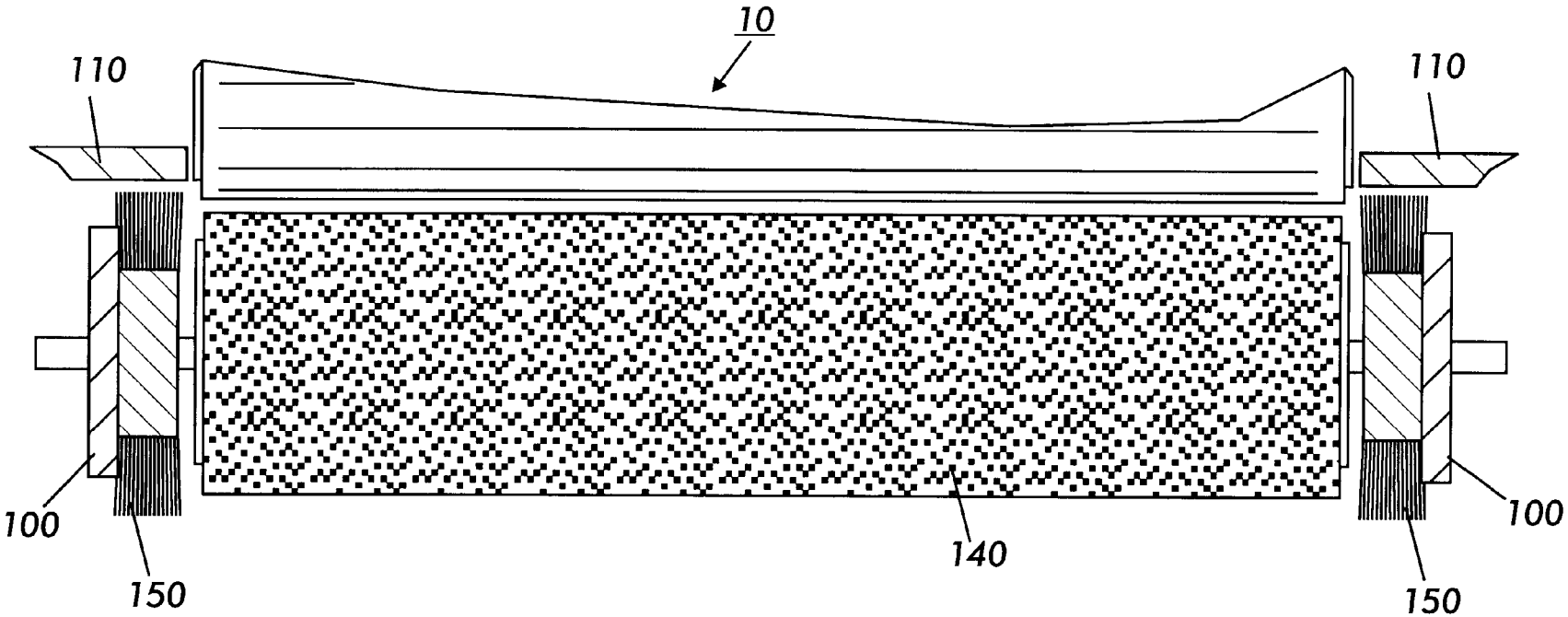
FIG. 4 is a schematic of the brush with raised fibers to cushion the cleaner landing.

Reference is now made to FIG. 4, which shows another embodiment of the present invention. Another method of adding a shock absorbing material to a retracting brush cleaner, is to shear the ends of the electrostatic brush 140 longer than the normal brush pile height. The retraction and engagement motion of the brush 140 is shown by arrow 105. For example, if a spacer wheel 100 is currently used to set at 2 mm BPI, the brush fibers 150 will extend 2 mm beyond the spacer wheel 100 in a radial direction. As the spacer wheel 100 moves towards the photoreceptor backers 110, the 2 mm of brush 140 will impact the photoreceptor 10 before the spacer wheels 100 contact the backers 110. By increasing the brush pile height on the ends of the brush, the shock absorption of the brush is increased, outside of the image area, so the cleaner operation is unaffected. After the longer fibers 150 compress, the hard spacer wheel maintains the proper BPI in the image area. FIG. 4 shows a version of a cleaner brush with raised fibers to cushion (e.g. dampen) the cleaner landing. The above stated methods have the advantage of being easily implemented into existing design. These embodiments can also be applied to spacer stops with shapes other than wheels.

Figure 5:
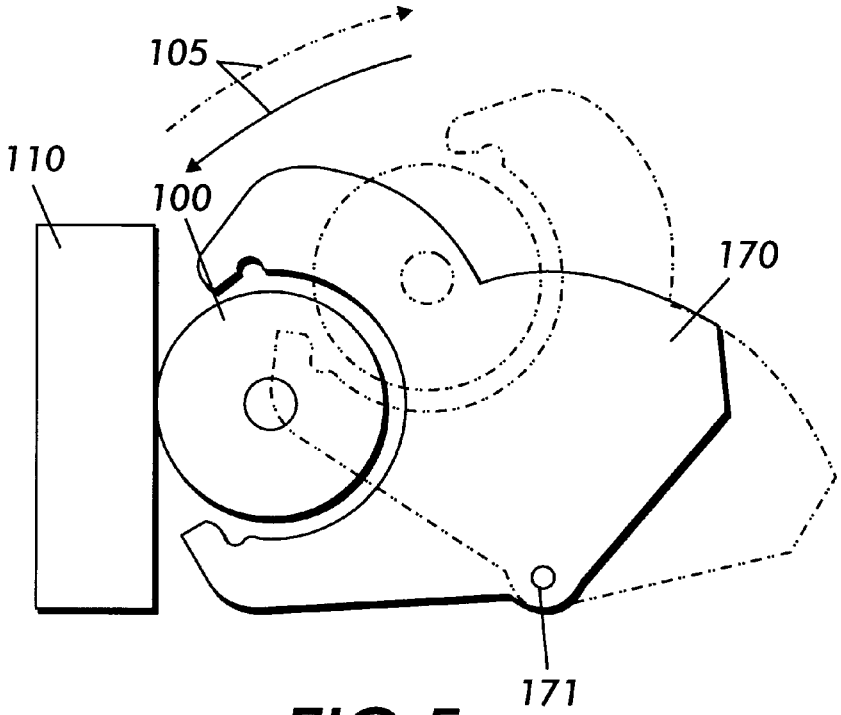
FIG.5 Prior Art
FIG. 5 is a prior art schematic of a flat backer used as a stop for the retractable cleaner spacer wheel.

A multipass xerographic system requires a cleaning subsystem which retracts. In addition to the requirement for acceptable cleaning of toner off of the photoreceptor, the cleaner must have a low impact force on the photoreceptor belt module in order to not disturb image quality. Traditional photoreceptor backers for retracting cleaners have consisted of a single contact point to set the cleaner position as it engages. This apparatus decelerates the cleaner engagement motion instantaneously causing a high impact force on the photoreceptor. FIG. 5 shows the prior art of current configuration where a flat backer 110 is used to stop the spacer wheel 100 allowing a high impact force between the cleaner and the photoreceptor causing an image quality disturbance.

Figure 6:
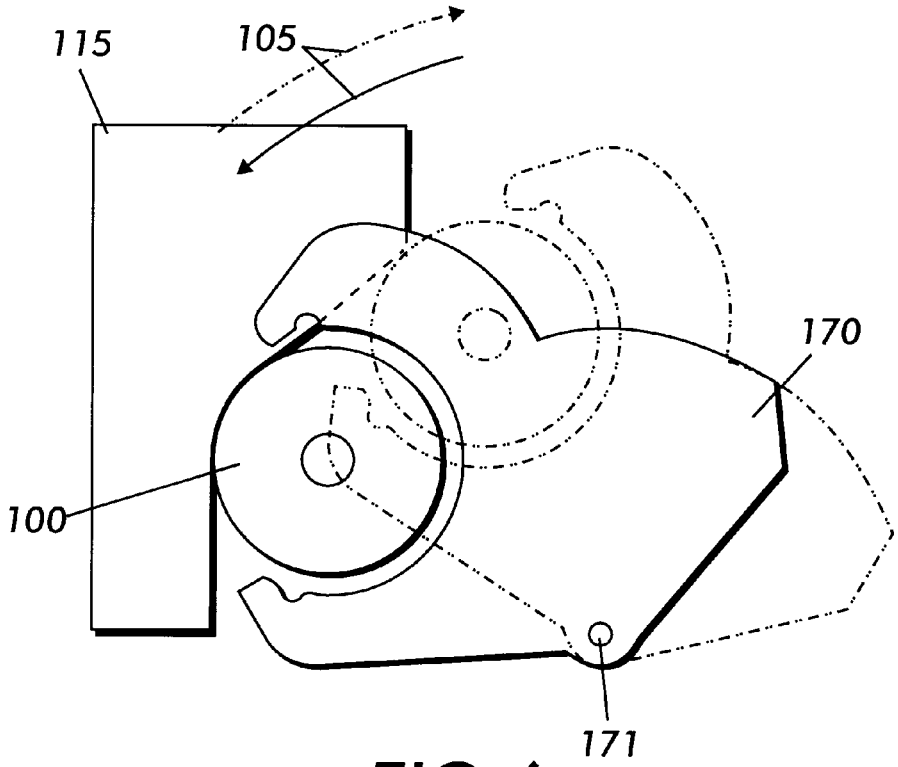
FIG. 6 is a schematic of a ramped backer that decelerates the retractable cleaner as it moves toward contact with the photoreceptor.
Figure 8:
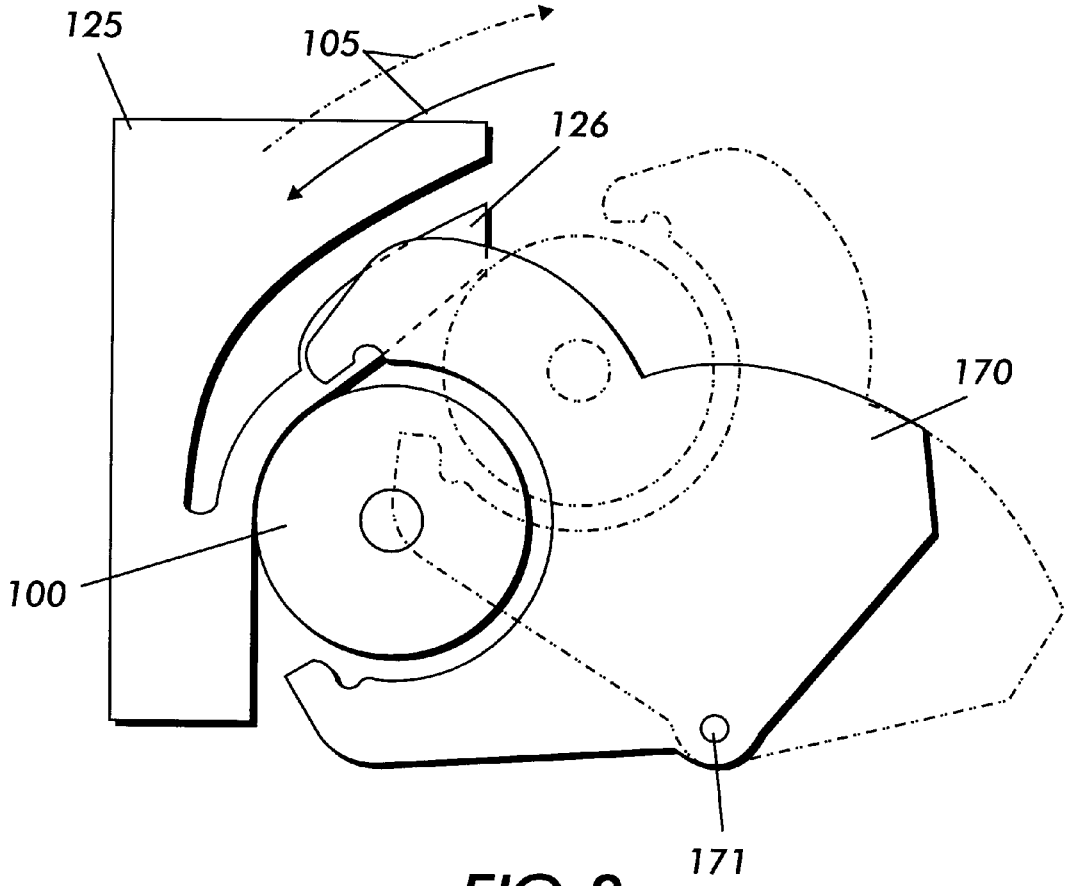
FIG. 8 is a schematic of an alternate ramped backer embodiment with a retractable cleaner.

Reference is now made to FIG. 6 which shows another embodiment of the present invention. FIG. 6 shows a ramped backer 115 to decelerate the cleaner (not shown) as it engages the photoreceptor. In this embodiment, ramping the backer bar avoids the instantaneous deceleration of the spacer wheel 100 by the photoreceptor backer bar(s) shown in FIG. 5. By using a ramped backer 115 to gently decelerate the cleaner, the impact force that disturbs the image quality by shaking the photoreceptor belt module is eliminated. The angle of the "ramped" portion of the backer is sufficient to prevent instantaneous impact between the spacer wheel 100 and the backer. The ramped backer 115 provides a gradual increase in interference with the spacer wheel 100 to the full BPI at the home position, causing the cleaner to decelerate with minimum impact force into an engaged position with the photoreceptor. The movement of the spacer wheel 100 is controlled by the movement of the retraction arm 170. The direction of movement of the retraction arm 170 about a pivot 171 is shown by the arrows 105. The resulting advantage is improved photoreceptor motion quality for the imaging system. This embodiment is inexpensive, easy to manufacture, and easily implemented on current retracting cleaners. The invention could also apply to other subsystems which have similar engage/retract requirements with the photoreceptor. FIG. 8 shows an alternate embodiment of a ramped backer 125 in a cleaner subsystem similar to that shown in FIG. 6. Ramped backer 125 has a lever section 126 that is of a thin material thickness to allow the backer bar deflection as the spacer wheel 100 travels to a seated position. This prevents binding of the cleaner brush assembly.

Figure 7:
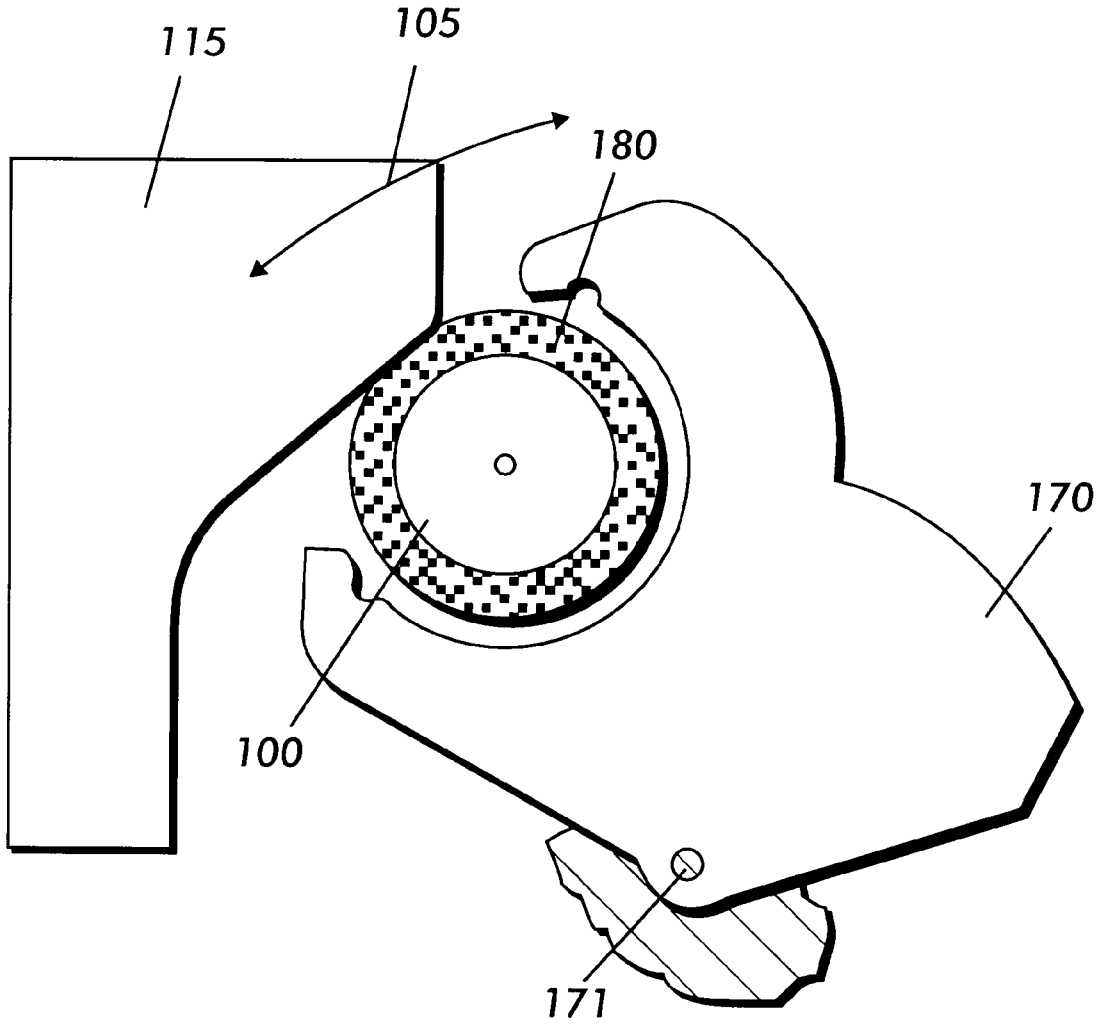
FIG. 7 is a schematic of a preferred embodiment of the present invention combining the ramped backer with a dampening material.
Figure 9:
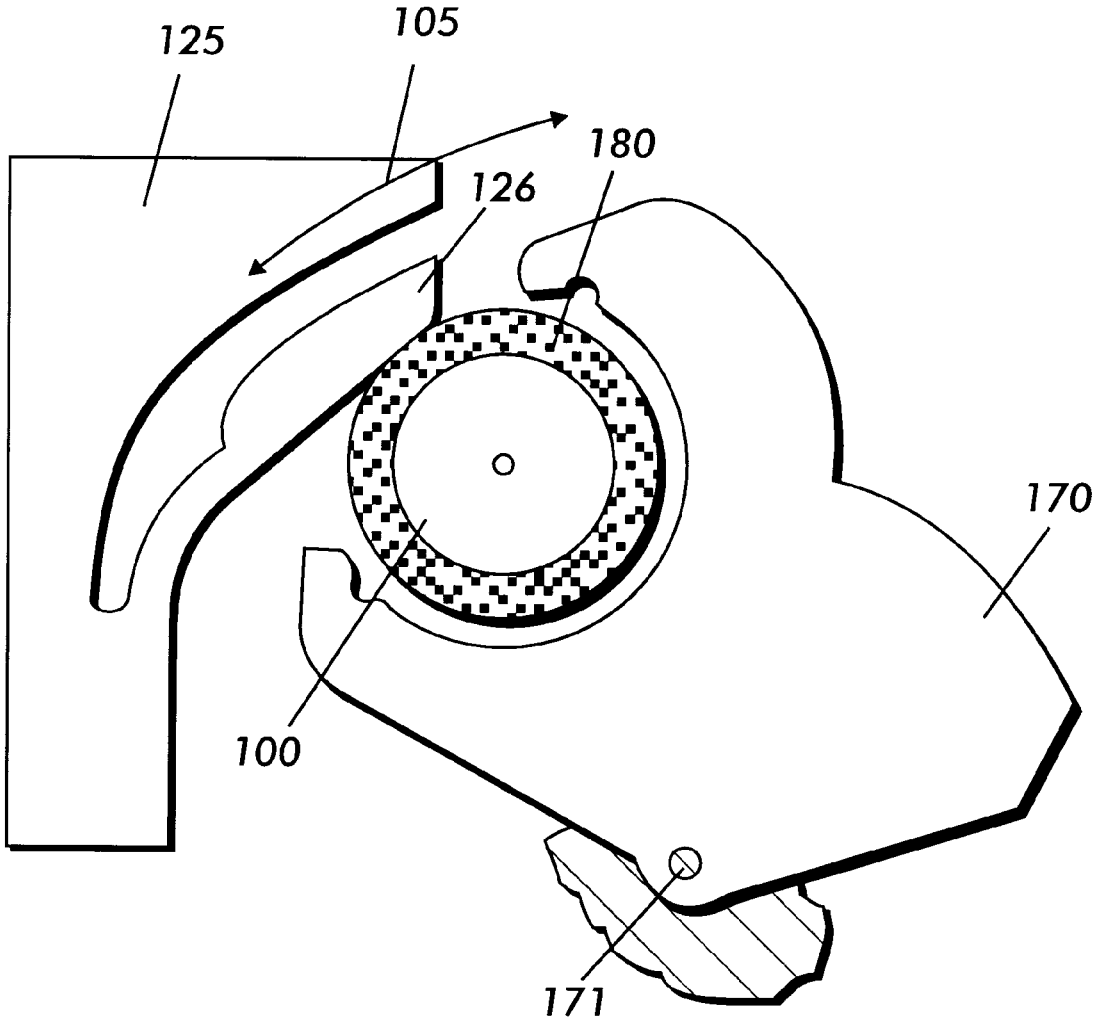
FIG. 9 is a schematic of an alternate ramped backer embodiment in combination with a dampening material.

Reference is now made to FIG. 7, which shows the preferred embodiment of the ramped backer combined with a shock absorbing material. The combination of a ramped backer 115 and a spacer wheel 100 that has a shock absorbing material 180 prevents an instantaneous deceleration of the spacer wheel 100 with the ramped backer 115. The shock absorbing material 180 includes the O-ring, foam coating and raised brush fibers referred to in FIGS. 2, 3 and 4. FIG. 9 shows an alternate embodiment of the ramped backer 125 in a cleaner subsystem similar to that shown in FIG. 7.

In recapitulation, the present invention utilizes a ramped backer and/or a shock absorbing material in a cleaner subsystem to reduce or prevent photoreceptor motion quality disturbances. These elements can be used separately or in combination for the present invention. The shock absorbing material prevents an instantaneous high impact force between the spacer wheel and the backer bar that can cause photoreceptor motion quality disturbance. The ramped backer prevents the instantaneous deceleration of the spacer wheel with the backer that causes motion quality disturbance due to the shaking of the photoreceptor belt from the impact on contact. The combination of the shock absorbing material and the ramped backer create a preferred embodiment of the present invention to prevent photoreceptor motion quality disturbance by the cleaner system.

It is, therefore, apparent that there has been provided in accordance with the present invention, an apparatus for preventing high impact force of a retractable cleaner that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for reducing and preventing motion quality defects of an imaging surface by a cleaning subsystem comprising:

a retractable cleaner member, having a first position and a second position, for cleaning the imaging surface, said retractable cleaner member being movable between the first position and the second position;

a spacer member for maintaining a desired distance between the imaging surface and said retractable cleaner member during engagement therebetween;

a ramped backer member, being positioned opposite said spacer member, to gradually decelerate said spacer member to reduce an impact force between said ramped backer member and said spacer member; and said spacer member comprising a dampening member to prevent an instantaneous high impact force contact between said spacer member and said ramped backer member that causes a motion quality disturbance of the imaging surface.

2. An apparatus as recited in claim 1, wherein said first position comprises said cleaner member being out of contact with the imaging surface.

3. An apparatus as recited in claim 2, wherein said second position comprises said cleaner member engagingly contacting the imaging surface to remove particles from the imaging surface.

4. An apparatus as recited in claim 1, wherein said ramped backer member having an angle sufficient to prevent instantaneous impact between said spacer member and said ramped backer member.

5. An apparatus for reducing and preventing motion quality defects of an imaging surface by a cleaning subsystem comprising:

a retractable cleaner member, having a first position out of contact with the imaging surface and a second position engagingly contacting the imaging surface, for cleaning the imaging surface, the retractable cleaner member being movable between the first position and the second position;

a spacer member having a spacer wheel to maintain a desired distance between the imaging surface and the retractable cleaner member during engagement therebetween said spacer wheel having an outer surface and a grooved edge along said outer surface;

a dampening member inserted into said grooved edge; and a backer member being positioned opposite said spacer member to decelerate said spacer member, said dampening member preventing an instantaneous high impact contact therebetween to prevent a motion quality disturbance of the imaging surface by the cleaning subsystem.

6. An apparatus as recited in claim 5, wherein said dampening member comprises an O-ring.

7. An apparatus for reducing and preventing motion quality defects of an imaging surface by a cleaning subsystem comprising:

a retractable cleaner member, having a first position out of contact with the imaging surface and a second position engagingly contacting the imaging surface, for cleaning the imaging surface, the retractable cleaner member being movable between the first position and the second position;

a spacer member having a spacer wheel to maintain a desired distance between the imaging surface and the retractable cleaner member during engagement therebetween, said spacer wheel having an outer surface;

a dampening member comprising a foam coating about the outer surface of said spacer wheel a backer member being positioned opposite said spacer member to decelerate said spacer member, said dampening member preventing an instantaneous high impact contact therebetween to prevent a motion quality disturbance of the imaging surface by the cleaning subsystem.

8. An apparatus for reducing and preventing motion quality defects of an imaging surface by a cleaning subsystem comprising:

a retractable cleaner member, having a first position out of contact with the imaging surface and a second position engagingly contacting the imaging surface, the retractable cleaner member being movable between the first position and the second position;

a spacer member having a spacer wheel to maintain a desired distance between the imaging surface and the retractable cleaner member during engagement therebetween;

a backer member being positioned opposite said spacer member to decelerate said spacer member, and said cleaner member being a brush cleaner having fibers extending radially from a core, said brush cleaner having a center region between two ends, said fibers having a longer brush pile height on the ends of said brush cleaner than in the center region and said longer brush pile height fibers extend radially longer than said spacer wheel, said longer brush pile height fibers compressing as the cleaner brush moves from the first position to the second position absorbing the impact force of contact between said backer member and said spacer wheel.

9. An apparatus for reducing and preventing motion quality defects of an imaging surface by a cleaning subsystem comprising:

a retractable cleaner member, having a first position out of contact with the imaging surface and a second position engagingly contacting the imaging surface, for cleaning the imaging surface, the retractable cleaner member being movable between the first position and the second position;

a spacer member to maintain a desired distance between the imaging surface and the retractable cleaner member during engagement therebetween; and a backer member being positioned opposite said spacer member to decelerate said spacer member, said backer member having a ramped entry, said ramped entry guiding said spacer member to said backer member as said cleaner member moves from the first position to the second position, said backer member and said spacer member preventing an instantaneous high impact contact therebetween to prevent a motion quality disturbance of the imaging surface by the cleaning subsystem.

10. An apparatus as recited in claim 9, wherein said ramped entry having an angle sufficient to prevent instantaneous impact between said spacer member and said backer member.

11. An apparatus for reducing and preventing motion quality defects of an imaging surface by a cleaning subsystem comprising:

a retractable cleaner member, having a first position and a second position, for cleaning the imaging surface, said retractable cleaner member being movable between the first position and the second position;

a spacer member for maintaining a desired distance between the imaging surface and said retractable cleaner member during engagement therebetween;

a ramped backer member, being positioned opposite said spacer member, to gradually decelerate said spacer member to reduce an impact force between said ramped backer member and said spacer member; and said spacer member having a shock absorbing material to prevent an instantaneous high impact force contact between said spacer member and said ramped backer member that causes a motion quality disturbance of the imaging surface.

12. An apparatus as recited in claim 11, wherein said first position comprises said cleaner member being out of contact with the imaging surface.

13. An apparatus as recited in claim 12, wherein said second position comprises said cleaner member engagingly contacting the imaging surface to remove particles from the imaging surface.

14. An apparatus as recited in claim 11, wherein said ramped backer member having an angle sufficient to prevent instantaneous impact between said spacer member and said ramped backer member.

15. An electrostatographic printing machine comprising:

an imaging surface, capable of movement, advances past a charging station for charging of the imaging surface;

an exposure station through which the imaging surface moves, the imaging surface having charged portions being exposed to a scanning device that discharges the imaging surface forming a latent image thereon;

a development station advances toner particles into contact with the latent image on the imaging surface as the imaging surface moves through said development station;

a transfer station advances a print media for transfer of the toner particles adhered to the latent image onto the print media, the toner particles of the latent image being permanently affixed to the print media via fusing of the latent image of toner particles to the print media;

a cleaning station for removal of the toner particles remaining on the imaging surface after transfer, said cleaning station including: a retractable cleaner member, having a first position out of contact with said imaging surface and a second position engagingly contacting said imaging surface, for cleaning the imaging surface, said retractable cleaner member being movable between the first position and the second position; a spacer member having a spacer wheel to maintain a desired distance between the imaging surface and said retractable cleaner member during engagement therebetween, said spacer wheel having an outer surface and grooved edge along the outer surface of said spacer wheel; a backer member being positioned opposite said spacer member to decelerate said spacer member, a dampening member inserted into said grooved edge of said spacer wheel preventing an instantaneous high impact contact therebetween to prevent a motion quality disturbance of the imaging surface by the cleaning subsystem.

16. A printing machine as recited in claim 15, wherein said dampening member comprises an O-ring.

17. A printing machine as recited in claim 16, wherein said dampening member comprises a foam coating about the outer surface.

18. An electrostatographic printing machine comprising:

an imaging surface, capable of movement, advances past a charging station for charging of the imaging surface;

an exposure station through which the imaging surface moves, the imaging surface having charged portions being exposed to a scanning device that discharges the imaging surface forming a latent image thereon;

a development station advances toner particles into contact with the latent image on the imaging surface as the imaging surface moves through said development station;

a transfer station advances a print media for transfer of the toner particles adhered to the latent image onto the print media, the toner particles of the latent image being permanently affixed to the print media via fusing of the latent image of toner particles to the print media; and a cleaning station for removal of the toner particles remaining on the imaging surface after transfer, said cleaning station including: a retractable cleaner member, having a first position out of contact with said imaging surface and a second position engagingly contacting said imaging surface, for cleaning the imaging surface, said retractable cleaner member being movable between the first position and the second position; a spacer member having a spacer wheel to maintain a desired distance between the imaging surface and said retractable cleaner member during engagement therebetween; a backer member being positioned opposite said spacer member to decelerate said spacer member, said cleaner member being a brush cleaner having fibers extending radially from a core, said brush cleaner having a center region between two ends, said fibers having a longer brush pile height on the ends of said brush cleaner then in the center region and said longer brush pile height fibers extend radially longer than said spacer wheel, said longer brush pile height fibers compressing as the cleaner brush moves from the first position to the second position absorbing the impact force of contact between said backer member and said spacer wheel.

19. An electrostatographic printing machine comprising:

an imaging surface, capable of movement, advances past a charging station for charging of the imaging surface;

an exposure station through which the imaging surface moves, the imaging surface having charged portions being exposed to a scanning device that discharges the imaging surface forming a latent image thereon;

a development station advances toner particles into contact with the latent image on the imaging surface as the imaging surface moves through said development station;

a transfer station advances a print media for transfer of the toner particles adhered to the latent image onto the print media, the toner particles of the latent image being permanently affixed to the print media via fusing of the latent image of toner particles to the print media; and a cleaning station for removal of the toner particles remaining on the imaging surface after transfer, said cleaning station including: a retractable cleaner member, having a first position out of contact with said imaging surface and a second position engagingly contacting said imaging surface, for cleaning the imaging surface, said retractable cleaner member being movable between the first position and the second position; a spacer member to maintain a desired distance between the imaging surface and said retractable cleaner member during engagement therebetween; a backer member being positioned opposite said spacer member to decelerate said spacer member, said backer having a ramped entry, said ramped entry guiding said spacer member to said backer member as said cleaner member moves from the first position to the second position; said backer member and said spacer member preventing an instantaneous high impact contact therebetween to prevent a motion quality disturbance of the imaging surface by the cleaning subsystem.

20. An apparatus as recited in claim 19, wherein said ramped entry having an angle sufficient to prevent instantaneous impact between said spacer member and said backer member.

21. A method for preventing a motion quality disturbance of an imaging surface by a cleaner subsystem for removing particles therefrom, comprising:

engaging a retractable cleaner member, having a first position and a second position, for cleaning the imaging surface, the retractable cleaner member being movable between the first position and the second position;

using a spacer member to maintain a desired distance between the imaging surface and the retractable cleaner member during engagement therebetween;

decelerating the spacer member, using a backer member positioned opposite the spacer member, eliminating an instantaneously high impact contact between the spacer member and the backer member to prevent a motion quality disturbance to the imaging surface; and ramping the backer member at a sufficient angle to prevent the instantaneously high impact contact between the spacer member and the backer member to prevent a motion quality disturbance to the imaging surface.

22. A method for preventing a motion quality disturbance of an imaging surface by a cleaner subsystem for removing particles therefrom, comprising:

engaging a retractable cleaner member, having a first position and a second position, for cleaning the imaging surface, the retractable cleaner member being movable between the first position and the second position;

using a spacer member to maintain a desired distance between the imaging surface and the retractable cleaner member during engagement therebetween;

decelerating the spacer member, using a backer member positioned opposite the spacer member, eliminating an instantaneously high impact contact between the spacer member and the backer member to prevent a motion quality disturbance to the imaging surface;

providing a dampening member for the spacer member preventing an instantaneously high impact contact between the spacer member and the backer member to prevent the motion quality disturbance to the imaging surface; and ramping the backer member at a sufficient angle to prevent an instantaneously high impact contact between the spacer member and the backer member to prevent a motion quality disturbance to the imaging surface.

* * * * *